US009883758B2

(12) United States Patent
Maple et al.

(10) Patent No.: US 9,883,758 B2
(45) Date of Patent: Feb. 6, 2018

(54) DRINKING VESSEL

(71) Applicants: Wade Maple, Spokane, WA (US); Jeff Steininger, S. Mary's, OH (US)

(72) Inventors: Wade Maple, Spokane, WA (US); Jeff Steininger, S. Mary's, OH (US)

(73) Assignee: Zak Designs, Inc., Spokane, WA (US)

( * ) Notice: Subject to any disclaimer, the term of this patent is extended or adjusted under 35 U.S.C. 154(b) by 541 days.

(21) Appl. No.: 14/604,403

(22) Filed: Jan. 23, 2015

(65) Prior Publication Data

US 2016/0213177 A1 Jul. 28, 2016

(51) Int. Cl.

| | |
|---|---|
| ***B65D 8/00*** | (2006.01) |
| ***A47G 19/22*** | (2006.01) |
| ***A45F 3/16*** | (2006.01) |
| ***A45F 3/18*** | (2006.01) |

(52) U.S. Cl.

CPC ..... *A47G 19/2227* (2013.01); *A45F 3/16* (2013.01); *A45F 3/18* (2013.01)

(58) Field of Classification Search

CPC ..... A47G 19/22; A47G 19/2209; A47G 19/2227; A47J 41/02; A45F 3/16; A45F 3/18

USPC ..... 220/8

See application file for complete search history.

(56) References Cited

U.S. PATENT DOCUMENTS

| | | | | |
|---|---|---|---|---|
| D461,367 | S * | 8/2002 | Scott | D7/515 |
| 6,527,137 | B1 * | 3/2003 | Kleckauskas | A47G 19/2227 215/388 |
| 2003/0076671 | A1 * | 4/2003 | Diak/Ghanem | A47G 19/2227 362/101 |
| 2012/0055964 | A1 * | 3/2012 | Gluck | A47G 19/2227 224/267 |

* cited by examiner

*Primary Examiner* — Steven A. Reynolds
*Assistant Examiner* — Javier A Pagan
(74) *Attorney, Agent, or Firm* — Randall Danskin P.S.

(57) ABSTRACT

A drinking vessel for determining an amount of a liquid which is consumed and which includes a first portion, which has a base portion and a vertically, upwardly extending wall, and wherein the vertically upwardly extending wall defines an internal cavity, and the exterior-facing surface thereof defines a multiplicity of continuous, circumscribing, longitudinally spaced grooves; and a multiplicity of continuous, elastomeric members are individually received in the respective spaced grooves and which can be moved along the exterior-facing surface of the drinking vessel so as to permit a user to readily account for the amount of fluid they have consumed during a given time interval.

6 Claims, 6 Drawing Sheets

DRINKING VESSEL

TECHNICAL FIELD

The present invention relates to a drinking vessel for determining the amount of a liquid consumed by a user during the course of their daily activities.

BACKGROUND OF THE INVENTION

As is well known in society, physicians and other health care providers recommend the consumption of a given amount of liquid, particularly water, on a daily basis. The most common recommendation for water consumption is approximately eight 8 ounce glasses per day, for a total of 64 ounces per day. The consumption of water within this recommended range is particularly important for persons engaged in weight loss or daily physical activity.

However, due to the myriad of activities and tasks a person is engaged in on a daily basis, keeping a record of the consumption of a liquid may be easily disregarded or even forgotten. As such, a recording procedure is usually necessary. To be successful, the ease of the recording procedure is paramount, such as not to needlessly increase the complexity of the activities a person must perform on a daily basis. In order to further this ease of use, the recording procedure should be incorporated or be made a feature of the drinking vessel such that the user can record consumptive uses with each refill of the drinking vessel.

The recording process must also not interfere with the sanitary use of the drinking vessel, and should also permit the user to easily clean the drinking vessel between each consumptive use or as desired by the user.

Finally, the recording process should engage the user in a manner which promotes the continued consumption of the liquid so as to maintain a healthy lifestyle as recommended by the health care community.

The present invention addresses a perceived and important need for many people, in that it provides a drinking vessel which includes an integrated system for tracking the consumption of a liquid such as water. In the present invention, the exterior facing surface of the drinking vessel is embossed or otherwise fabricated with a series of circumscribing grooves. Within each of these grooves resides a colored elastomeric band. As the user completely consumes the liquid within the drinking vessel, the elastomeric bands may be moved longitudinally along the exterior face of the drinking vessel in either an upward or downward direction, depending upon the desire of the user, to a collection area. Alternatively, the user can remove a single elastomeric band with each consumptive use and place the band around their wrist, for example, each time the liquid within the drinking vessel is consumed. Once all eight elastomeric bands have been moved to the collection area on the drinking vessel, or placed around the wrist of the user, the user can clean the drinking vessel and reset the individual elastomeric bands within the respective circumscribing grooves to ready the drinking vessel, yet again, for use.

SUMMARY OF THE INVENTION

A first aspect of the present invention relates to a drinking vessel which includes a first portion which has a base portion, and a vertically upwardly extending wall which is made integral with the base portion, and wherein the vertically upwardly extending vertical wall further defines an internal cavity and an upper peripheral edge, and wherein the first portion is further defined by an exterior facing surface which defines a multiplicity of continuous, circumscribing, longitudinally spaced grooves; and a multiplicity of continuous elastomeric members which are individually received in the respective spaced grooves.

Still another aspect of the present invention relates to a drinking vessel which includes a first portion having a base portion, and a vertically upwardly extending wall which is made integral with the base portion, and wherein the base portion and vertically upwardly extending wall define a first internal cavity, and wherein the vertically upwardly extending wall further defines an upper peripheral edge having a given cross-sectional dimension, and wherein the vertically upwardly extending wall of the first portion has an exterior facing surface which defines a multiplicity of continuous, circumscribing, longitudinally spaced grooves, and which are oriented between the base portion, and the upper peripheral edge of the vertically upwardly extending wall; a second portion of the drinking vessel which includes a base portion, and a vertically upwardly extending wall which is made integral with the base portion of the second portion, and wherein the base portion, and vertically upwardly extending wall of the second portion defines a second internal cavity for receiving and dispensing a fluid for consumption by a user, and wherein the second portion of the drinking vessel is telescopingly received within the first internal cavity as defined by the first portion of the drinking vessel; and a multiplicity of continuous elastomeric members which individually, matingly, and resiliently cooperate with the respective spaced grooves which are defined by the exterior facing surface of the first portion of the drinking vessel, and wherein the user of the drinking vessel forcibly moves the respective elastomeric members in a given direction along the exterior facing surface of the first portion of the drinking vessel.

Still another aspect of the present invention relates to a drinking vessel which includes a first portion of the drinking vessel which has a base portion, and a vertically upwardly extending wall which is made integral with the base portion, and wherein the base portion and vertically upwardly extending wall define a first internal cavity, and wherein the vertically upwardly extending wall further defines an upper peripheral edge having a given cross-sectional dimension, and which permits access to the first internal cavity, and wherein the first portion of the drinking vessel is further defined, at least in part, by a longitudinal axis, and wherein the vertically upwardly extending wall of the first portion has an exterior facing surface which defines a multiplicity of continuous, circumscribing, longitudinally spaced grooves, and which are oriented between the base portion, and the upper peripheral edge of the vertically upwardly extending wall; a second portion of the drinking vessel which includes a base portion, and a vertically upwardly extending wall which is made integral with the base portion of the second portion, and wherein the base portion, and vertically upwardly extending wall of the second portion defines a second internal cavity for receiving, and dispensing, a fluid for consumption by a user, and wherein the second portion of the drinking vessel is telescopingly received within the first internal cavity as defined by the first portion of the drinking vessel, and wherein the base portion of the second portion is located in spaced relation relative to the base portion of the first portion, and wherein the second portion of the drinking vessel is secured to the first portion of the drinking vessel at a location which is in spaced relation relative to the upper peripheral edge of the first portion of the drinking vessel; and a multiplicity of continuous elastomeric members which individually, matingly, and resiliently cooperate with the respective spaced grooves which are defined by the exterior facing surface of the first portion of the drinking vessel, and wherein the user of the drinking vessel forcibly moves the respective elastomeric members in a longitudinal direction along the exterior facing surface of the first portion of the drinking vessel as the user consumes the fluid contained in the second portion of the drinking vessel so that the user can readily determine the amount of the fluid which has been consumed.

These and other aspects of the present invention will be described in greater detail hereinafter.

DETAILED DESCRIPTION OF THE PREFERRED EMBODIMENTS

This disclosure of the invention is submitted in furtherance of the constitutional purposes of the U.S. Patent Laws "to promote the progress of science in useful arts" [Article 1, Section 8]

Figure 1:
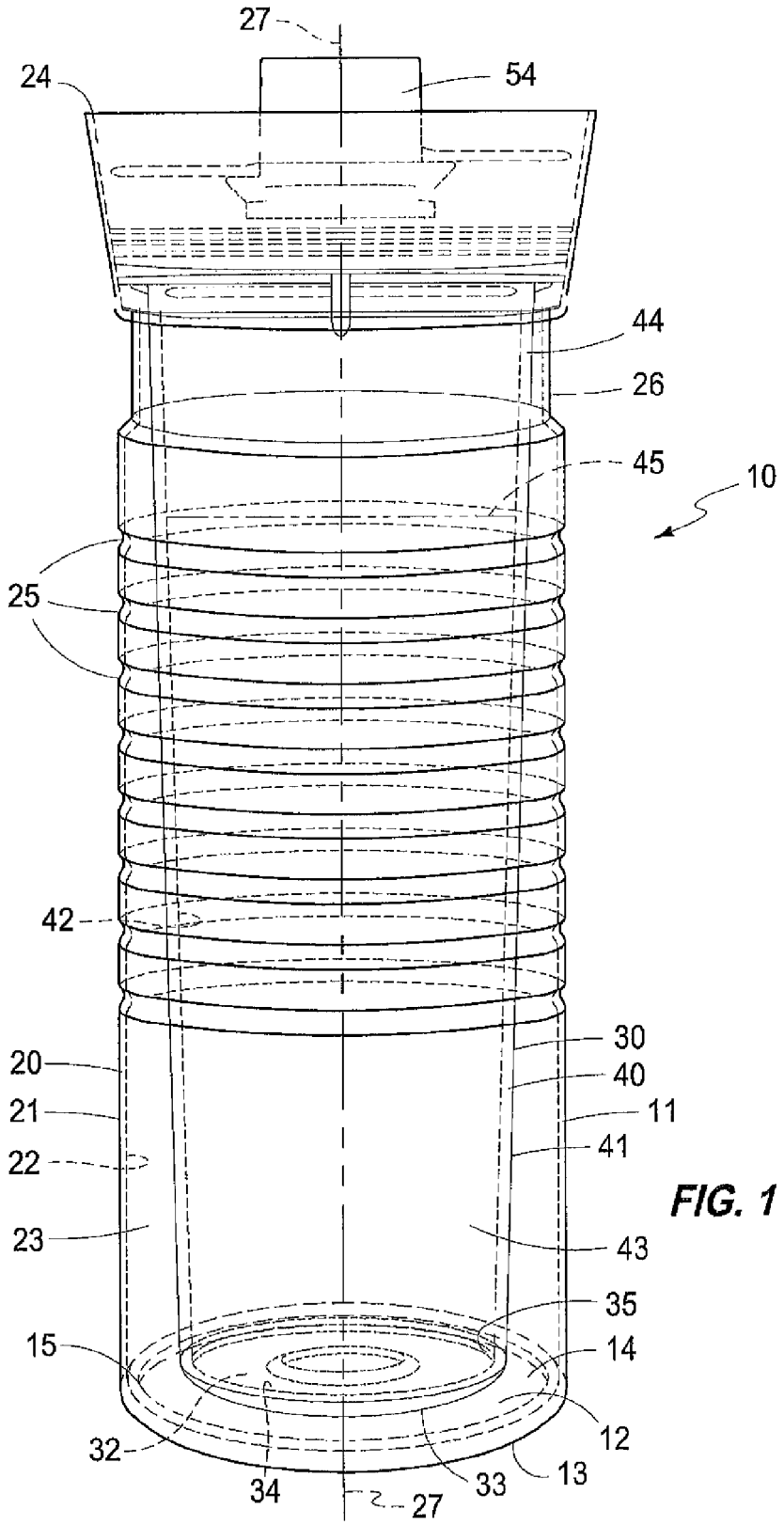
FIG. 1 is a side elevation view of the drinking vessel of the present invention, and which is illustrated without the presence of individual moveable elastomeric members.

Referring now to the drawings, the drinking vessel of the present invention is generally indicated by the numeral 10 in FIG. 1 and following. As understood by a study of the drawings, the drinking vessel 10 includes a first portion 11. The first portion 11 further includes a base portion 12, which has an outside-facing surface 13, an inside-facing surface 14, and further is defined by a peripheral edge 15. The base portion 12 is substantially concavely curved when viewed from the opposite end of the drinking vessel 10, as will be described, below.

The first portion 11 of the drinking vessel 10 further includes a vertically, upwardly extending wall 20, which is made integral with the base portion 12, The vertically, upwardly extending wall 20 has an exterior-facing surface 21, and an opposite interior-facing surface 22. The interior-facing surface 22 defines an internal cavity 23. The vertically, upwardly extending wall has an upper peripheral edge 24 (FIG. 7), and which defines an aperture and which further permits access to the drinking vessel 10. As illustrated in FIG. 1, and following, a multiplicity of continuous, circumscribing and longitudinally spaced grooves or channels 25 are formed in the exterior-facing surface 21, of the first portion 11, and which are further longitudinally spaced along the longitudinal dimension of the drinking vessel 10.

Figure 4:
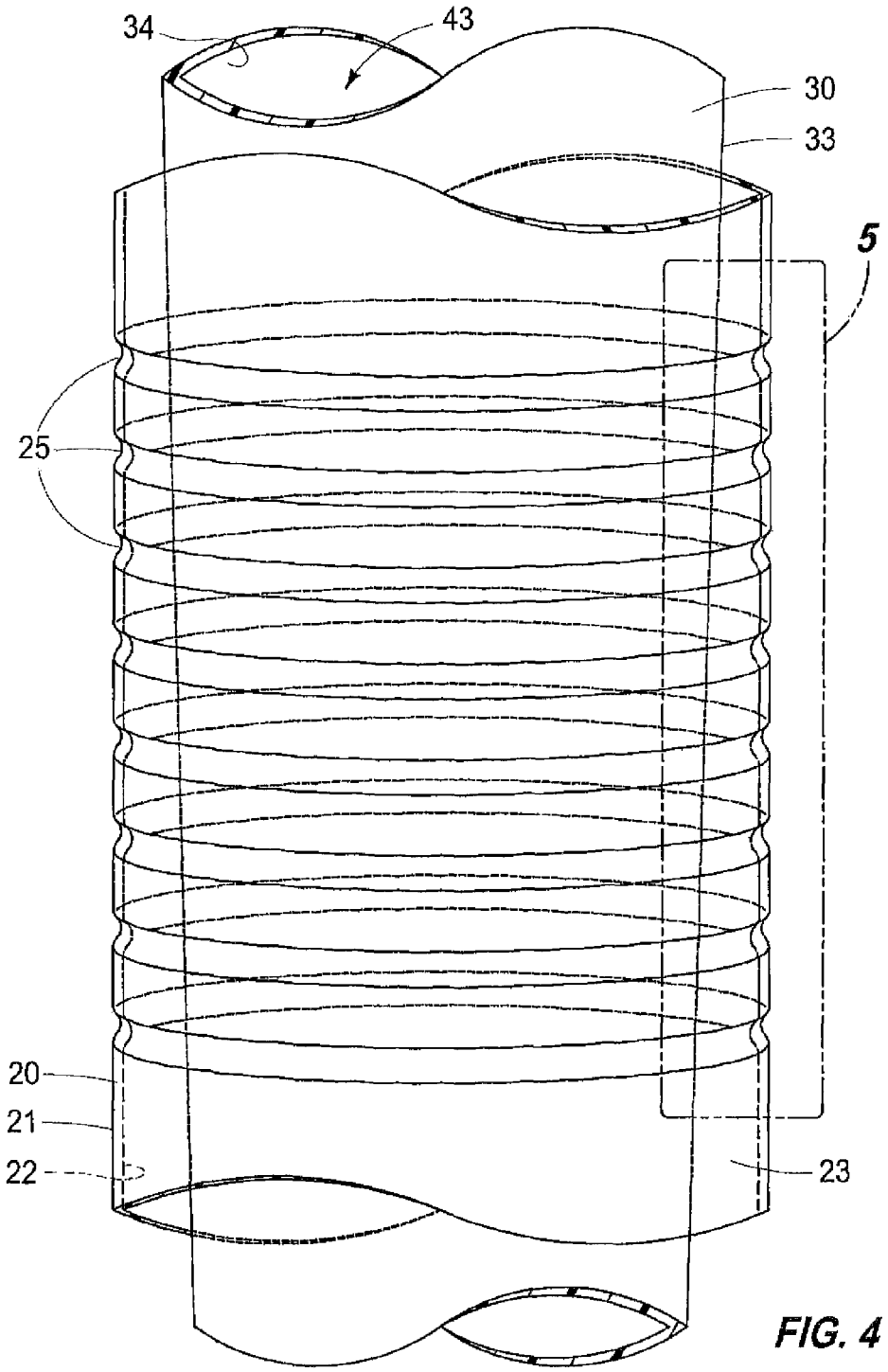
FIG. 4 is a partial, greatly enlarged, side elevation view of a portion of the drinking vessel of the present invention.

As best seen by reference to FIGS. 4 and 5, the multiplicity of continuous circumscribing and longitudinally spaced grooves 25 here are shown having a semi-hemispherical or concavely shaped profile, which are operable to matingly receive individual elastomeric members, which will be discussed in greater detail hereinafter. However, it will be recognized that other shaped profiles will work with an equal degree of success. Still further, the exterior-facing surface 21 defines a circumscribing recessed region 26, which is formed in the exterior-facing surface 21, and which is positioned in spaced relation relative to the upper peripheral edge 24 of the vertically, upwardly extending wall 20. The recessed region 26 (FIG. 7) is dimensioned so as to receive and accommodate the storage of a multiplicity of continuous elastic members, as will be described in greater detail below. This recessed region, in the alternative, may be located near the base portion 12, Further, a recessed region may be located in each place. As can be seen by FIG. 1, the internal cavity 23 of the first portion has a variable internal cross-sectional dimension when this is measured from the upper peripheral edge 24, and in the direction of the base portion 12. Still further, and as seen in the drawings, it will be recognized that the vertically, upwardly extending wall 20 in the region of the upper peripheral edge 24, inclines laterally, outwardly in a flaring manner so as to facilitate the dispensing of the liquid, which is contained within the drinking vessel 10, as will be described below. The first portion 11 is further defined by a longitudinal axis 27, and which is seen in FIG. 1.

Figure 3:
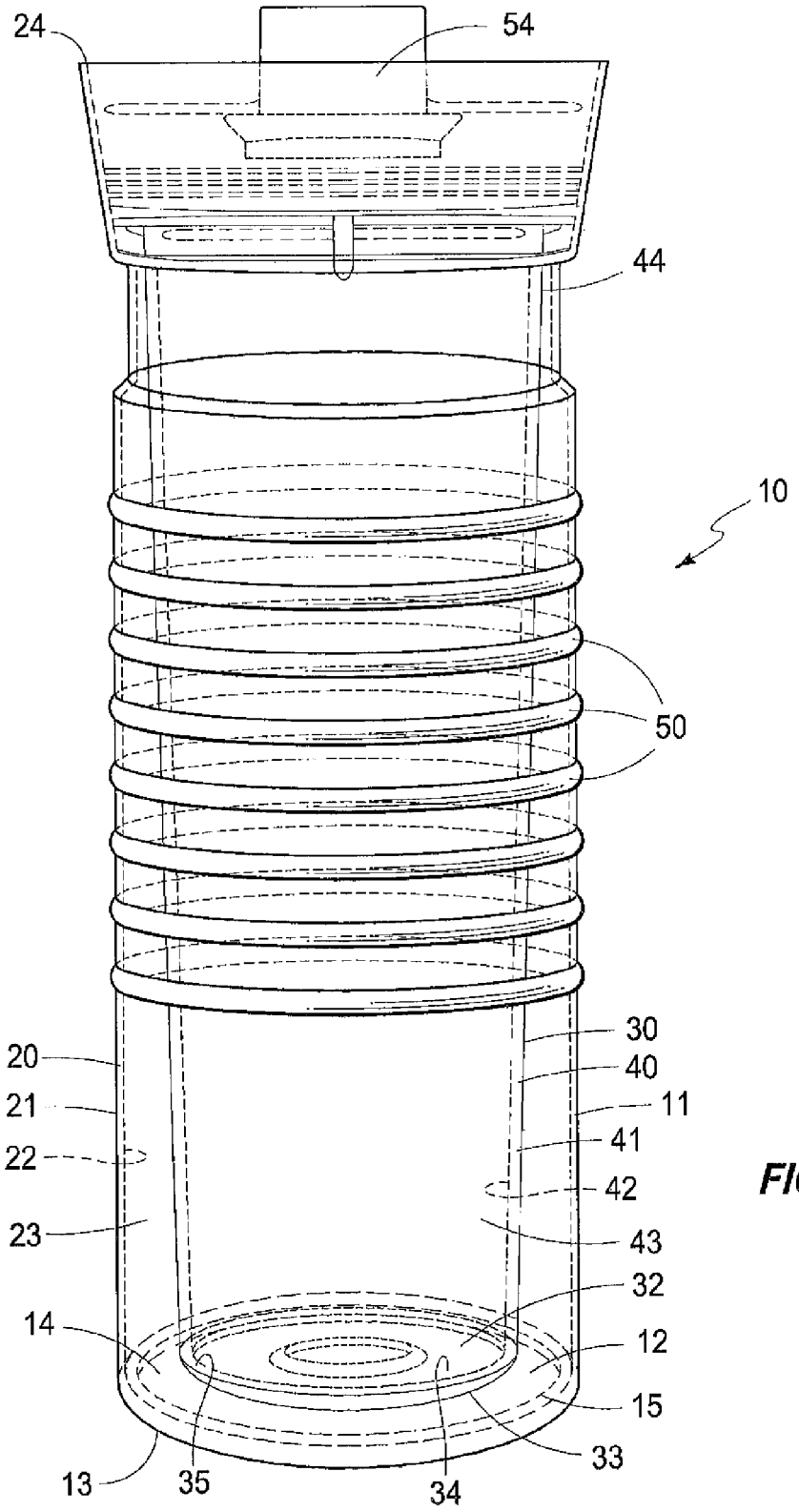
FIG. 3 is a side elevation view of the present invention shown with the multiplicity of elastomeric members positioned in spaced relation along a drinking vessel.

The drinking vessel 10 includes a second portion 30. The second portion 30 is defined, in part, by a base portion 32. The base portion 32 has an outside facing surface 33, and an opposite, inside-facing surface 34. Still further, the base portion 32 has a peripheral edge 35. As seen in the drawings, the second portion includes a vertically, upwardly extending wall 40, which is made integral with the peripheral edge 35 of the base portion 32. The vertically, upwardly extending wall 40 has an exterior-facing surface 41, and an opposite, interior-facing surface 42 (FIG. 3). The interior-facing surface 42 defines an internal cavity 43, which is operable to receive and enclose a source of a liquid, or other fluid to be dispensed 45 (FIG. 1). Still further, the vertically, upwardly extending wall 40 has an upper peripheral edge 44. The upper peripheral edge 44 is affixed to the interior-facing surface 22 of the first portion 11 at a location which is spaced from the upper peripheral edge 24 thereof. This arrangement permits the drinking vessel 10 to have a single-wall construction at the upper peripheral edge 24. This single-wall construction provides for a more comfortable "mouth feel" when a user is drinking from the vessel 10. Still further, as seen in the drawings, it will be understood that the second portion 30 is telescopingly received within the first internal cavity 23, as defined by the first portion 11; and the base portion 32 of the second portion 30 is disposed in predetermined, spaced relation relative to the base portion 12 of the first portion 11. The spaced relationship of the second portion 30, relative to the first portion 11, provides some insulative benefit for the fluid or other liquid 45 which is received within the second internal cavity 43, as defined by the second portion 30. As should be understood, and in one possible form of the invention, the second portion could be eliminated, and just the first portion would be utilized to hold and dispense a beverage, for example.

Figure 2:
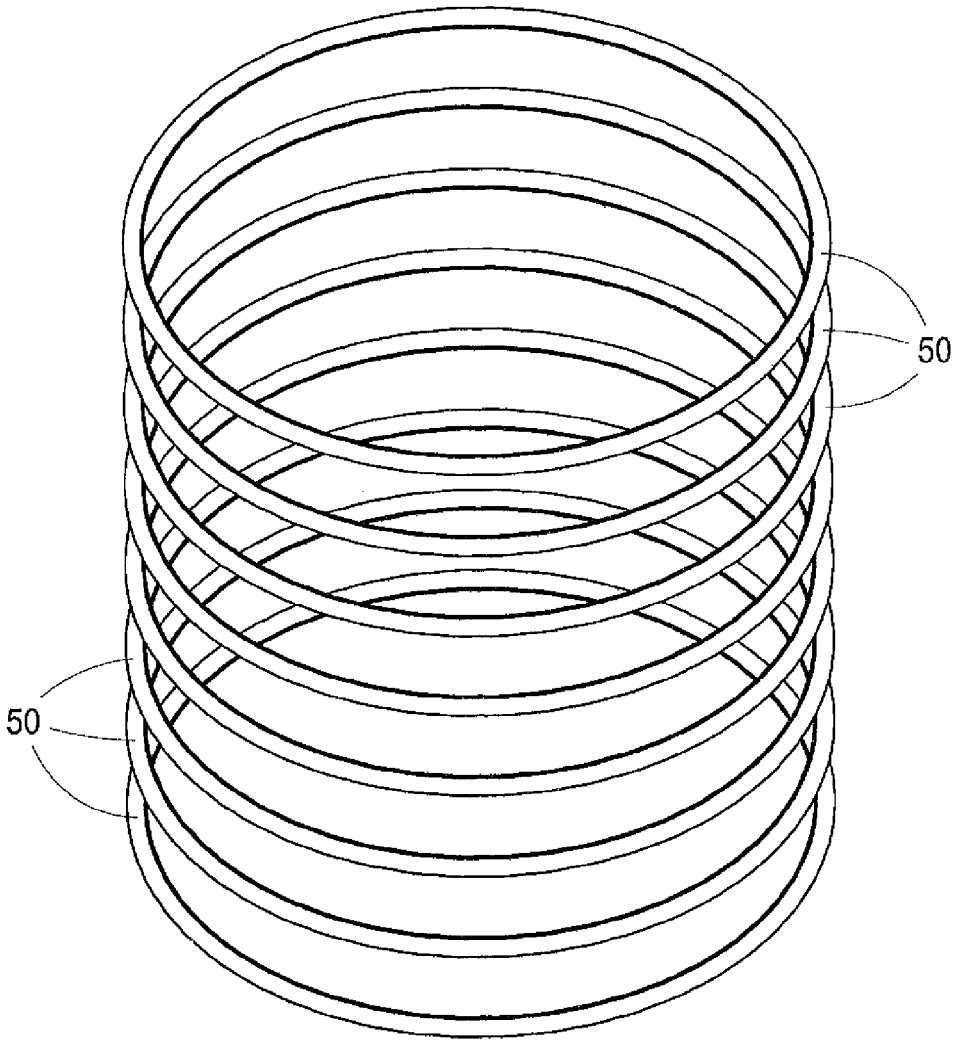
FIG. 2 is a perspective view of a multiplicity of elastomeric members which are used in combination with the drinking vessel as seen in FIG. 1.
Figure 5:
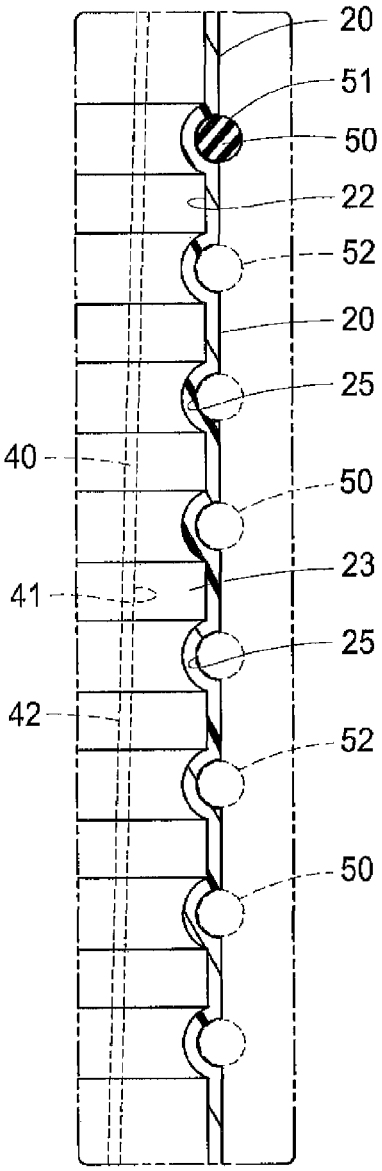
FIG. 5 is a partial, longitudinal, transverse, vertical sectional view showing the relationship of the aforementioned elastomeric bands and the exterior surface of the drinking vessel.
Figure 6:
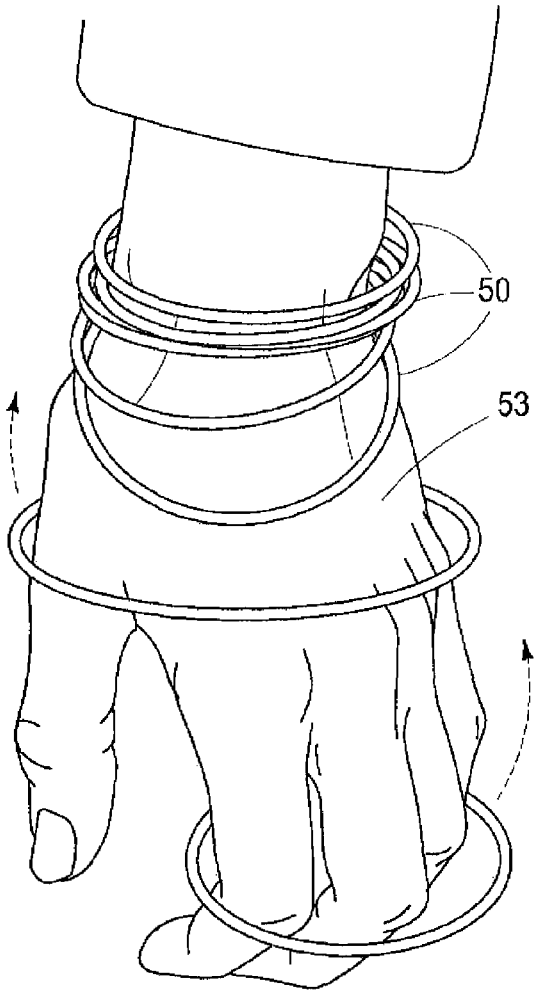
FIG. 6 is a side elevation view of a user's hand bearing the elastomeric members employed with the present invention.
Figure 7:
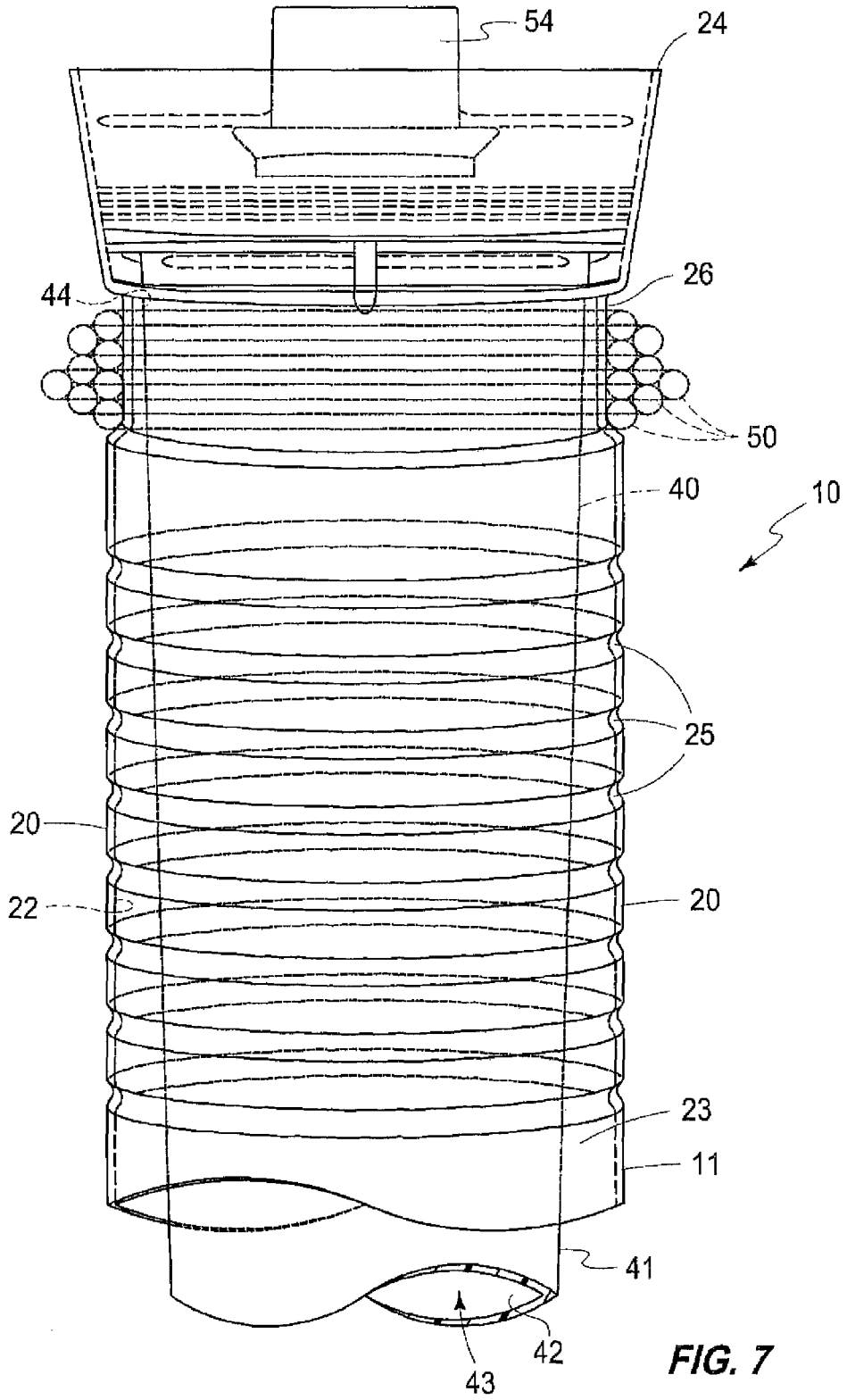
FIG. 7 is a partial, side elevation view of the drinking vessel showing the elastomeric members positioned within a recessed region that is defined by the drinking vessel.

The drinking vessel 10 of the present invention includes a multiplicity of continuous elastomeric members, which are generally indicated by the numeral 50 (FIG. 2), and which further can be resiliently deformed so as to fit about, and be matingly received within, the multiplicity of continuous circumscribing longitudinally spaced grooves 25 (FIG. 5). Each of these elastomeric members have a main body 51, which has an exterior-facing surface 52. In one possible form of the invention, the exterior-facing surface 52 may be colored in different hues so as to provide a rainbow-like effect when viewed by a user. Otherwise, the multiplicity of elastomeric members can be uncolored, and are further resiliently deformable so as to be enlarged and moved in a direction, longitudinally, along the first portion 11, either in a direction towards the upper peripheral edge 24, or on the other hand, in the direction of the base portion 12. As seen in FIG. 6, and as one possible use of the present invention, the individual continuous, elastomeric members 50 may be removed as a user drinks water, for example, from the drinking vessel 10, and can then be placed around the hand or wrist 53 of the user so as to remind the user during the day to continue to drink the required volume of water which is necessary to maintain their health. On the other hand, and as seen in FIG. 7, the multiplicity of continuous elastomeric members 50, may be moved in the direction of the upper peripheral edge 24, and into the recessed region 26, as best indicated by reference to FIG. 7. Once the drinking vessel 10 is depleted, or the given volume of fluid has been consumed, the individual elastomeric members 50 may be moved back into individual mating receipt within each of the multiplicity of continuous circumscribing, longitudinally spaced grooves 25, so as to begin the process again. As seen in the drawings, the drinking vessel 10 further includes a removable lid 54, which is operable to be matingly received, and located in an occluding orientation relative to the second portion 30, thereby retaining the fluid contained within the internal cavity 43, while the drinking vessel 10 is not in use.

Operation

The operation of the described embodiment of the present invention is believed to be readily apparent, and is briefly summarized at this point. In its broadest aspect, the present invention relates to a drinking vessel 10 for determining an amount of a liquid which is consumed, and which further includes a first portion 11. The first portion has a base portion or region 12, and a vertically, upwardly extending wall 20, which is made integral with the base portion 12. The vertically, upwardly extending wall 20 defines an internal cavity 23, and an upper peripheral edge 24 of the first portion. The first portion 11 is further defined by an exterior facing surface 21, and which further defines a multiplicity of continuous, circumscribing, longitudinally spaced grooves 25. The drinking vessel 10 also includes a second portion 30, which has a base portion 32, and a vertically, upwardly extending wall 40, which is made integral with the base portion 32 of the second portion 30. The vertically, upwardly extending wall 40 further defines an upper peripheral edge 44 of the second portion 30. The second portion 30 cooperates with the first portion 11. In one possible form of the invention, the second portion 30 could be eliminated. The drinking vessel 10 also includes a multiplicity of continuous annular shaped elastomeric members 50, which are individually received in mating relationship within the respective concave shaped spaced grooves 25. Further, the present invention includes a lid 54, which matingly cooperates with the first portion 11 of the drinking vessel 10 and which substantially occludes the internal cavity 23 of the first portion 11.

It should be understood that in one form of the invention, the base portion 12, and the vertically, upwardly extending wall 20 of the first portion 11 defines a first internal cavity 23, and the second portion 30 is telescopingly received within the first internal cavity 23. Additionally, the vertically upwardly extending wall 20 of the first portion 11 defines an upper peripheral edge 24, and which further has a given cross-sectional dimension. This cross-sectional dimension is greater than a cross-sectional dimension of the base portion 12. In the arrangement as seen in the drawings, the continuous circumscribing, longitudinally spaced grooves 25 are oriented between the base portion 12 and the upper peripheral edge 24 of the vertically, upwardly extending wall 20 of the first portion 11. Still further, it should be understood that the base portion 32, and the vertically, upwardly extending wall of the second portion 30, defines a second internal cavity 43 for receiving and dispensing of fluid 45 for consumption by a user.

In the arrangement as seen in the drawings, and in one form of the invention, the second portion 30 of the drinking vessel 10 is telescopingly received within the first internal cavity 13, as defined by the first portion 11 of the drinking vessel 10. Still further the vertically, upwardly extending wall 40 of the second portion 30 is located in spaced relation relative to the vertically, upwardly extending wall 20 of the first portion 11. In the arrangement as seen in the drawings, the continuous elastomeric members 50 individually, matingly, and resiliently cooperate with the respective spaced grooves 25, which are defined by the exterior-facing surface 21 of the first portion 11 of the drinking vessel 10. These further can be moved along in the vertically, upwardly extending wall 20 of the first portion 11, so as to permit a user to keep a record of a quantity of a beverage which is consumed by the user.

In the arrangement as seen in the drawings, a user 53 of the drinking vessel 10 forcibly moves the respective elastomeric members 50 in a given direction along the exterior-facing surface 21 of the first portion of the drinking vessel 10, so as to account for the amount of fluid 45 which has been consumed by the user. Still further, the invention includes an upper peripheral edge 44, which forms a portion of the second portion 30, and which is secured to the first portion 11, at a location which is disposed in spaced relation relative to the upper peripheral edge 24 of the first portion 11. In the arrangement as seen in the drawings, the base portion 12 of the first portion 11 is convexly curved when viewed from the upper peripheral edge 24 of the first portion 11.

Therefore, it will be seen that the present invention provides a convenient means whereby a user can conveniently account for the amount of fluid they drink during a given time interval so that they may maintain a healthy lifestyle. The present invention is easy to use, convenient to operate, and further provides both a visual and actual means by which users can accurately track the amount of fluid they intake during any given time period.

In compliance with the statute, the invention has been described in language more or less specific as to structural, methodical features. It should be understood, however, that the invention is not limited to the specific features shown and described since the means herein disclosed comprise preferred forms of putting the invention in effect. The invention is, therefore, claimed in any of its forms or modifications within the proper scope of the appended claims, appropriately interpreted in accordance with the doctrine of equivalence.

We claim:

1. A drinking vessel for keeping track of an amount of a fluid a user consumes, comprising:

a first portion of the drinking vessel which includes a base portion, and a vertically upwardly extending wall which is made integral with the base portion, and wherein the base portion and vertically upwardly extending wall define a first internal cavity, and wherein the vertically upwardly extending wall further defines an upper peripheral edge having a given cross-sectional dimension, and which permits access to the first internal cavity, and wherein the first portion of the drinking vessel is further defined, in part, by a longitudinal axis, and wherein the vertically upwardly extending wall of the first portion has an exterior facing surface, and an opposing interior facing surface;

a multiplicity of spaced apart concave shaped circumscribing grooves defined in the exterior facing surface of the first portion of the drinking vessel and located between the base portion, and the upper peripheral edge, and wherein each one of the multiplicity of spaced apart concave shaped grooves is sized, and configured to releasably and positionally maintain one elastomeric member within the concave shaped circumscribing groove;

a circumscribing, recessed region defined in the exterior facing surface of the first portion of the drinking vessel and spaced apart from the multiplicity of concave shaped circumscribing grooves, and wherein the circumscribing recessed region sized is configured to simultaneously receive, and releasably, and positionally maintain, a plurality of elastomeric members that have been moved longitudinally along the exterior facing surface of the first portion of the drinking vessel and out of engagement with the respective concave shaped circumscribing grooves; and a multiplicity of annular shaped elastomeric members, each having a circular cross-section and a dimension, and wherein each annular elastomeric member is releasably, matingly received in one of the respective spaced apart concave shaped grooves defined in the exterior facing surface of the first portion of the drinking vessel, and wherein the user of the drinking vessel forcibly rolls each respective annular elastomeric members in a longitudinal direction along the exterior facing surface of the first portion of the drinking vessel from a first position where the respective elastomeric members are in engagement with one of the plurality of concave shaped circumscribing grooves, which provides a first indicator to the user of an amount of fluid the user should consume from the drinking vessel, to a second position of engagement wherein the respective elastomeric members are located within the circumscribing recessed region, that is spaced apart from the multiplicity of concave shaped circumscribing grooves, so as to provide a second indicator to the user of the amount of fluid consumed from the drinking vessel so that the user can readily keep track of the amount of the fluid which has been consumed.

2. The drinking vessel as claimed in claim 1 and further comprising:

a second portion which includes a base portion, and a vertically upwardly extending wall which is made integral with the base portion, and wherein the vertically upwardly extending wall of the second portion further defines a second internal cavity and has an upper peripheral edge; and the second portion of the drinking vessel is telescopingly received within the first internal cavity defined by the first portion of the drinking vessel, and the vertically upwardly extending wall of the second portion is located in spaced relation relative to the vertically upwardly extending wall of the first portion.

3. The drinking vessel as claimed in claim 2, and wherein the upper peripheral edge of the second portion is secured to the first portion, at a location which is disposed in spaced relation relative to the upper peripheral edge of the first portion.

4. The drinking vessel, as claimed in claim 1, and further comprising:

a lid that releasably engages the drinking vessel at the upper peripheral edge, and further substantially occludes the internal cavity.

5. The drinking vessel as claimed in claim 1, and wherein each of the multiplicity of annular shaped elastomeric members have a circular cross-section and a predetermined thickness dimension which is substantially equal to or greater than a width dimension of each of the multiplicity of circumscribing longitudinally spaced concave shaped grooves, and wherein when each annular shaped elastomeric member is located within one of the circumscribing, longitudinally spaced concave shaped grooves, the respective annular shaped elastomeric members are oriented, at least in part, in a radially outwardly extending orientation relative to the exterior facing surface of the first portion.

6. The drinking vessel as claimed in claim 1, and wherein the vertically, upwardly extending sidewall of the first portion extends increasingly, laterally, outwardly, as the upwardly extending sidewall extends in the direction from the recessed region of the first portion of the drinking vessel to the upper peripheral edge thereof.

* * * * *